US006056116A

United States Patent [19]

Troska

[11] Patent Number: 6,056,116

[45] Date of Patent: May 2, 2000

[54] NOISE SUPPRESSED PRIZE DISPENSER FOR A CONTAINER

[75] Inventor: Georg Troska, Herten, Germany

[73] Assignee: The Coca-Cola Company, Atlanta, Ga.

[21] Appl. No.: 08/998,454

[22] Filed: Dec. 24, 1997

[51] Int. Cl.[7] ..... B65D 85/72

[52] U.S. Cl. ..... 206/217; 53/420; 206/831

[58] Field of Search ..... 206/217, 457, 206/459.1, 459.5, 831; 53/410, 420

[56] References Cited

U.S. PATENT DOCUMENTS

| | | |
|---|---|---|
| 3,656,654 | 4/1972 | Brinkley, III . |
| 4,109,817 | 8/1978 | Payne et al. . |
| 4,228,913 | 10/1980 | Mack et al. . |
| 4,305,521 | 12/1981 | Komatsuta et al. . |
| 4,356,927 | 11/1982 | Cooper et al. . |
| 4,537,324 | 8/1985 | Wang . |
| 4,690,294 | 9/1987 | Jones . |
| 4,709,829 | 12/1987 | Johnson et al. . |
| 4,728,001 | 3/1988 | Serba . |
| 4,826,034 | 5/1989 | Forbes . |
| 4,892,187 | 1/1990 | Stein . |
| 4,911,320 | 3/1990 | Howes . |
| 4,923,083 | 5/1990 | Forbes . |
| 4,923,084 | 5/1990 | Forbes . |
| 5,046,631 | 9/1991 | Goodman . |
| 5,056,659 | 10/1991 | Howes et al. . |
| 5,056,681 | 10/1991 | Howes . |
| 5,071,019 | 12/1991 | Sizemore . |
| 5,099,232 | 3/1992 | Howes . |
| 5,172,827 | 12/1992 | Chang et al. . |
| 5,439,103 | 8/1995 | Howes . |
| 5,482,158 | 1/1996 | Plester . |

FOREIGN PATENT DOCUMENTS

| | | |
|---|---|---|
| 0079673 | 10/1982 | European Pat. Off. . |
| 0078789 | 11/1982 | European Pat. Off. . |
| 0444385 | 5/1990 | European Pat. Off. . |
| 0482776 | 10/1991 | European Pat. Off. . |
| 2217677 | 11/1989 | United Kingdom . |
| 2237789 | 5/1991 | United Kingdom . |
| 8901750 | 3/1989 | WIPO . |
| 9500414 | 1/1995 | WIPO . |

*Primary Examiner*—Jim Foster

*Attorney, Agent, or Firm*—Birch, Stewart, Kolasch & Birch, LLP

[57] ABSTRACT

A beverage can for housing liquid products and a prize therein includes a prize dispensing assembly which cannot be easily detected without opening the beverage can. The prize dispensing assembly includes a holder which is frictionally held inside a guide. The holder is held in a position such that it is displaced from an underside of an openable tab on a lid of the beverage can. By this arrangement, a consumer may not detect the presence of the holder inside the beverage can by tapping on the openable tab, or attempting to rattle the holder against the openable tab. The holder also includes a spring loaded cap for contacting the underside of the openable tab, in case the holder becomes dislocated and abuts against the openable tab. The spring loaded cap dampens the impact of the holder against the openable tab and thus reduces the possibility that the prize dispensing assembly will be discovered prior to opening the beverage can.

35 Claims, 8 Drawing Sheets

NOISE SUPPRESSED PRIZE DISPENSER FOR A CONTAINER

BACKGROUND OF THE INVENTION

1. Field of the Invention

The present invention relates to a container for housing a liquid product and a prize therein. More specifically, the present invention relates to a prize dispensing assembly for a beverage can which dispenses a prize when the can is opened. The prize dispensing assembly includes noise suppressing structures so that a consumer cannot discern that the prize dispensing assembly is located inside the can, prior to opening the can.

2. Description of the Background Art

A beverage can which includes a prize dispensing assembly is known from U.S. Pat. Nos. 5,482,158 and 5,056,659. Such prize bearing cans serve as promotional tools to increase the overall sale of beverages. As part of the promotion, prize bearing cans are randomly intermixed with non-prize bearing cans. The chance of purchasing a prize bearing can serves as an incentive for consumers to purchase the beverage.

In order for the promotion to be successful, consumers must not be able to discern whether a can is prize bearing, prior to purchasing and opening the can. If consumers could easily discern that a can was prize bearing, without opening the can, they would simply purchase the prize bearing cans. The chance or incentive of winning a prize would be lost for the non-prize bearing cans.

Usually, consumers have access to beverage cans prior to purchasing them, such as the cans located on display shelves in grocery and retail stores. Inside these stores, consumers are free to inspect and handle the beverage cans. Consumers, who are knowledgeable of the incentive promotion, will, as is human nature, closely inspect the material construction of the can and perhaps shake or attempt to rattle the can to discern if it has any distinctions from a normal can. Therefore, there exists a need in the art for a beverage can housing a prize dispensing assembly which cannot be easily discovered without opening the can.

SUMMARY OF THE INVENTION

Accordingly, it is a primary object of the present invention to provide an improved beverage can having a prize dispensing assembly therein which cannot be easily discovered without opening the beverage can.

Another object of the present invention is to provide a prize dispensing assembly for a beverage can which includes noise suppressing structures so that the prize assembly may not be discovered by shaking or attempting to rattle an unopened can.

Yet another object of the present invention is to provide a prize dispensing assembly for a beverage can which is easy to install and operates in a simple and reliable manner.

Still yet another object of the present invention is to provide a prize dispensing assembly for a beverage can which is simple and inexpensive to manufacture.

These and other objects of the present invention are fulfilled by providing a container assembly for housing liquid products and a prize, comprising:

a can body having an open end and a closed end, a lid covering said open end of said can body, said lid having an openable tab, said openable tab closing said can body when in a closed position and providing access to an interior of said can body when in an open position;

a guide located in the interior of said can body and adjacent said openable tab;

a holder movably mounted within said guide; and a locking strip movably mounted on said holder, said locking strip being juxtaposed between said holder and said guide when said openable tab is in the closed position, to chock said holder in a fixed position relative to said guide, said locking strip being released from between said holder and said guide when said openable tab is in the open position, whereby said holder is free to move within said guide.

Moreover, these and other objects are fulfilled by a method of operating and suppressing noise within a prize dispensing assembly of a beverage can, comprising the steps of:

providing a can body and a prize dispensing assembly inside the can body, the prize dispensing assembly including a guide, a holder, and a locking strip connected to the holder;

depositing a prize in the holder;

inserting the holder into the guide; and sandwiching the locking strip between the holder and the guide, wherein the holder with the prize is frictionally held stationary relative to the guide to thereby suppress noise caused by movement of the holder.

Additionally, these and other objects are fulfilled by a method of forming a prize dispensing beverage can, comprising the steps of providing a can body having an open end and a closed end, a lid, and a prize dispensing assembly, the lid having an openable tab, the prize dispensing assembly including a guide, a holder, and a locking strip connected to the holder; depositing a prize in the holder; inserting the holder into the guide; sandwiching the locking strip between the holder and the guide, whereby the holder with the prize is held stationary relative to the guide via a frictional force; and attaching the lid to the open end of the can body.

Furthermore, these and other objects are fulfilled by a method of forming a prize dispensing beverage can, comprising the steps of providing a can body having an open end and a closed end; providing a prize dispensing assembly with a prize dispensing portion; aligning the prize dispensing portion of the prize dispensing assembly with an openable tab of a can lid; frictionally engaging the prize dispensing assembly to the can lid to hold the prize dispensing assembly on the can lid; and inserting the can lid with the prize dispensing assembly onto the open end of the can body to thereby close the can body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
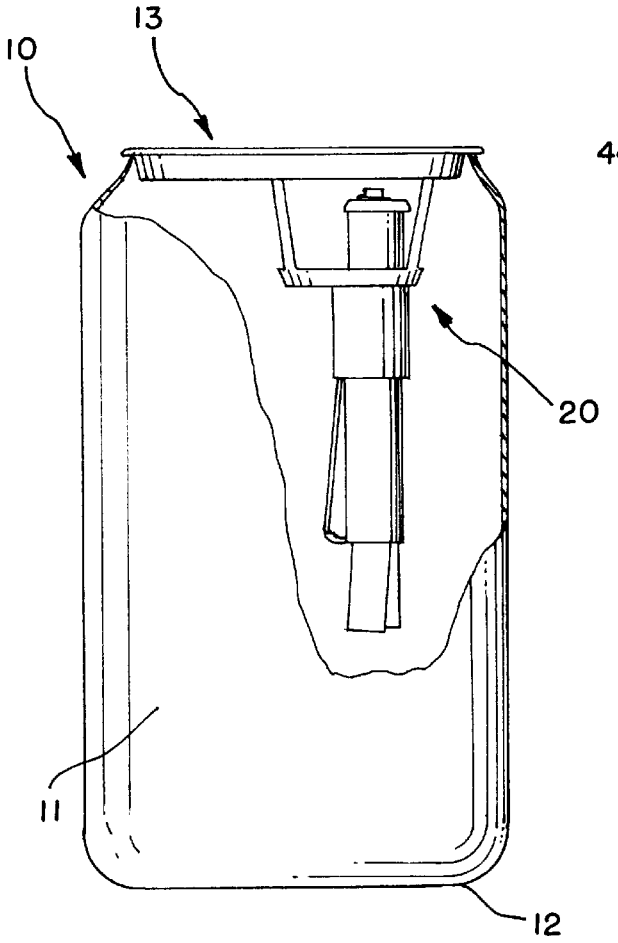
FIG. 1 is a side view, with a portion cut away, of a prize bearing beverage can of the present invention.

Referring in detail to the drawings and with particular reference to FIG. 1, a beverage can 10 containing a prize dispensing assembly 20 of the present invention is shown. The beverage can 10 includes a cylindrical can body 11, a circular closed end 12, and a circular open end closed by a lid 13.

Figure 11:
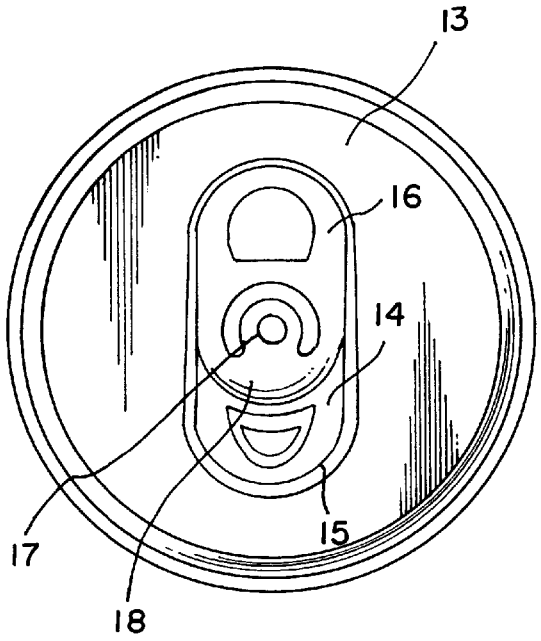
FIG. 11 is a top view of the prize bearing beverage can of FIG. 1.

As illustrated in FIG. 11, the lid 13 includes an openable tab 14. Openable tab 14 is in the shape of semi-ellipse or semi-circle and is outlined by a groove 15. A pivoting tab 16 is located adjacent the openable tab 14. When a person manually pivots the pivoting tab 16 about a stay 17, a force is exerted by a front end 18 of the pivoting tab 16 onto the openable tab 14. This force causes the openable tab 14 to breakaway from the lid 13 along the groove 15. The openable tab 14 then bends down inside the can body 11, and the beverage contained inside the can body 11 may be discharged through the lid 13.

Figure 2:
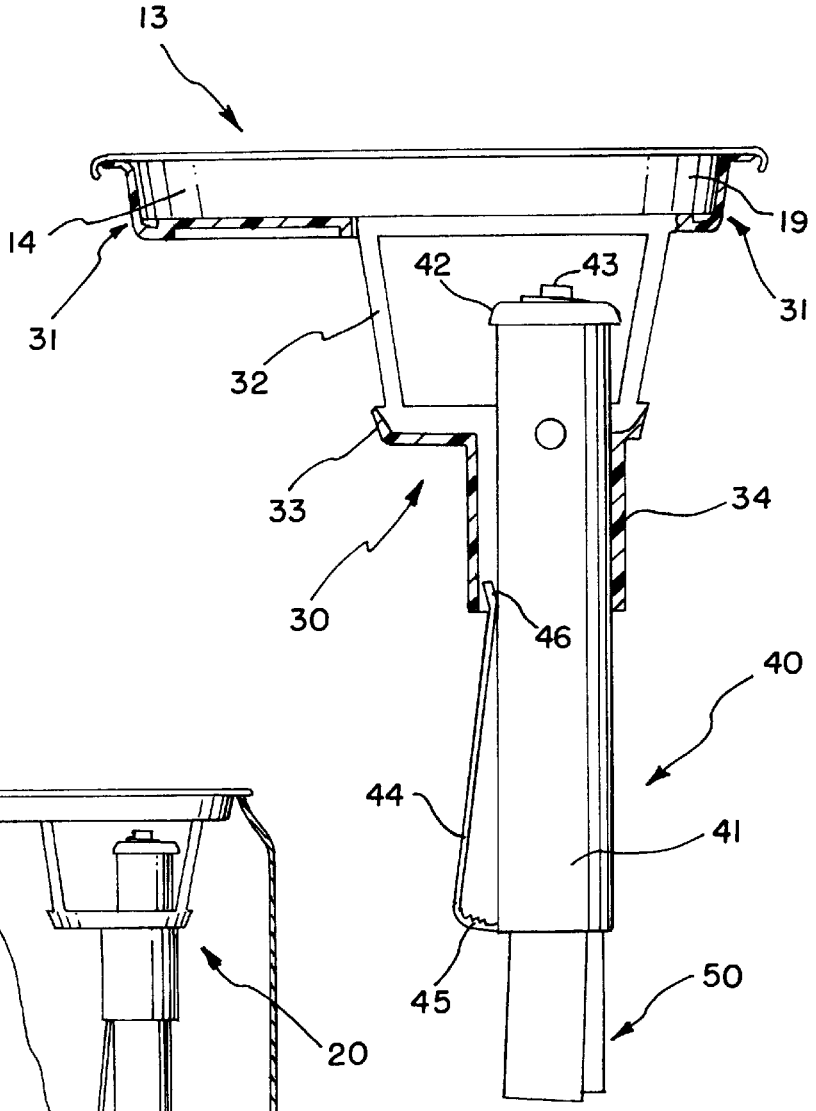
FIG. 2 is a partial cross-sectional view of a prize dispensing assembly of the present invention.

As illustrated in FIGS. 1 and 2, the prize dispensing assembly 20 includes a guide 30. Guide 30 includes an annular attachment lip 31 which initially, frictionally engages an inner rim 19 on a side of the lid 13 facing the interior of the can body 11. The frictional engagement can be assisted by a tackiness of the material used to construct the attachment lip 31. Alternatively, a special compound can be employed to maintain an adequate engagement between the attachment lip 31 and the lid 13. For example, glue can be used to hold lip 31 to lid 13, but it is contemplated that this lip 31 will merely be held by frictional engagement with the lid 13. By merely using this frictional fit, the number of assembling steps can be decreased when manufacturing the can. Also, the need to wait for drying of the adhesive is avoided therefore reducing time and costs for manufacturing the prize bearing cans. The frictional engagement between the attachment lip 31 and the lid 13 only serves to keep the prize dispensing assembly 20 properly aligned with the openable tab 14 during assembly.

Figure 12:
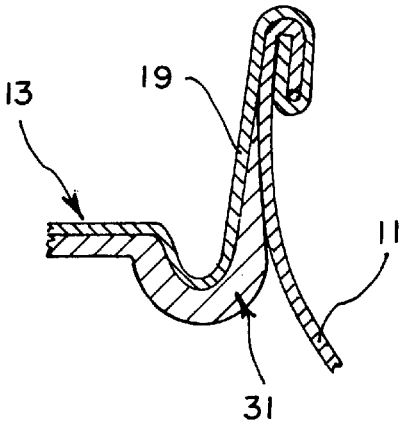
FIG. 12 is a cross-section view of a seaming of the can lid to the can body with a lip of the prize dispensing assembly fixed therebetween.

As illustrated in FIG. 12, the lid 13 is ultimately seamed to the can body 11. The seam between the lid 13 and the can body 11 captures the attachment lip 31. The seam between the lid 13 and the can body 11 is formed by rolling of the edges of the lid 13 and the can body 11. A portion of the attachment lip 31 may be included between the edges which are rolled, or the attachment lip 31 may be pinched by the start of the rolled edges. Since the attachment lip 31 is sandwiched between seamed lid 13 and can body 11, the prize dispensing assembly 20 is firmly attached adjacent to the lid 13 and will not rattle or break free from the lid 13 once the prize bearing beverage can 10 is fully assembled.

The assembly of the can lid 13 and prize dispensing assembly 20 to the can body 11 will now be described with reference to FIG. 18. The assembly method can be adapted to existing can assembly systems. In particular, it is known to seam a lid onto a filled can body. The lids are placed over the open end of the can body by a conventional seamer and are then affixed thereto.

In the method of the present invention, it is possible to feed the can bodies 11 through the conventional seamers, thereby avoiding major renovations to the canning line when a prize promotion is to be conducted. Basically, a unit 60 is added to the canning line between the filler 61 and seamer 62 for dropping can lids 13 with prize dispensing assemblies 20 attached thereto onto the filled can bodies 11. The prize bearing cans 10 then move into the conventional seamer 62 which has had the lid feeder turned off, or otherwise inactivated. The lids with the prize dispensing assemblies are then seamed onto the can body, and thereafter handled in a conventional manner. Of course, a seamer could be constructed for alternatively feeding lids with or without prize dispensing assemblies, onto the filled can bodies 11, such that the unit 60 would not need to be added to the canning line when a promotion was to be undertaken.

Four evenly spaced standoffs 32 are attached to the annular attachment lip 31 and extend away from the lid 13. The four standoffs 32 are also attached to a dish 33. Dish 33 includes a cylindrical tube 34 integrally formed therewith. The guide 30 is a one-piece, unitary construction of the attachment lip 31, standoffs 32, dish 33 and cylindrical tube 34. Of course, separate pieces which are welded, glued or otherwise connected together, could be used to form the guide 30. The views of FIGS. 1 and 2 illustrate two of the four standoffs. Although four standoffs are described, it should be clear that more or fewer standoffs would serve equally well.

Figure 3:
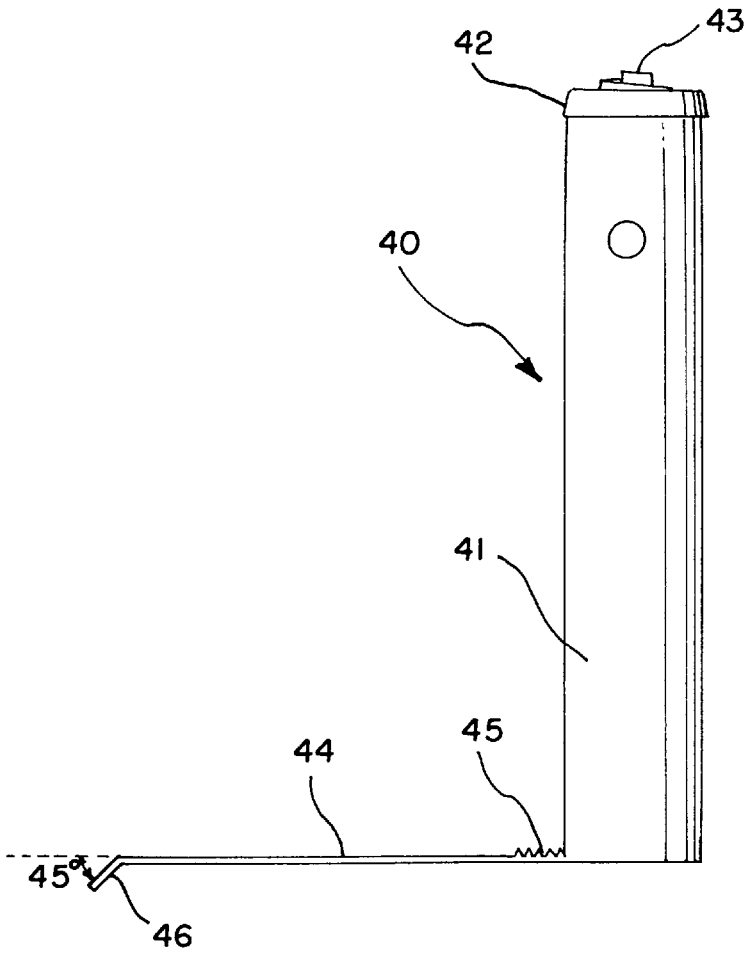
FIG. 3 is a side view of a vial for containing and delivering a prize for use in the prize dispensing assembly of FIG. 2.
Figure 4:
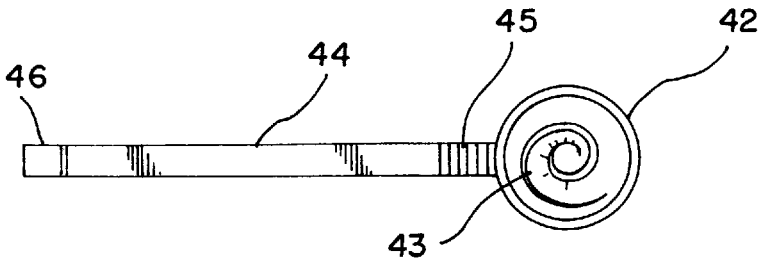
FIG. 4 is a top, plan view of the vial of FIG. 3.

As illustrated in FIGS. 3–4, a holder 40 is reciprocally mounted inside the cylindrical tube 34. The holder 40 includes a cylindrical vial 41 which is open on both ends. An upper end of the vial 41 is covered by a cap 42. Cap 42 includes a spiral spring 43 located in its center. Adjacent a lower end of the vial 41 is a locking strip 44. The locking strip 44 has a first end permanently attached near the lower end of vial 41. The locking strip 44 is constructed of a semi-rigid material. The locking strip 44 includes a rippled section 45 which facilitate bending of the locking strip 44 and an angled portion 46, located adjacent a second end of the locking strip 44. The angled portion 46 is approximately 3 mm in length and is angled at approximately forty-five degrees. Of course, the length and angle can be varied.

Figure 10:
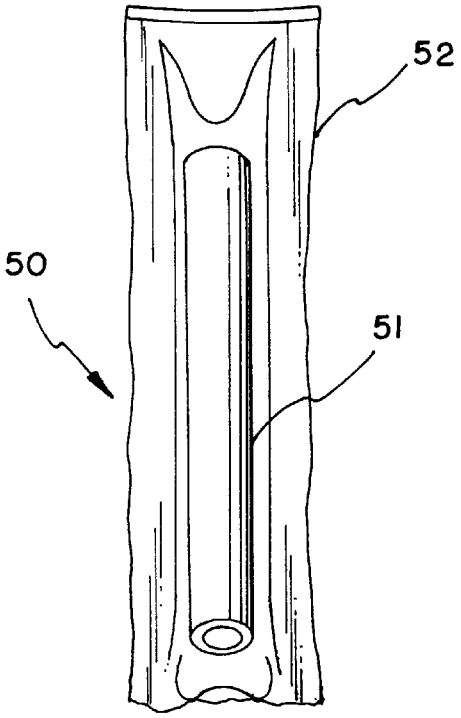
FIG. 10 is a side view of an unrolled sachet, and prize therein, to be housed in the vial of FIG. 3.

FIG. 10 illustrates a sachet 50 to be inserted into the holder 40. The sachet 50 includes a prize 51 and a wrapping 52 which protects the prize from the beverage contained in the can body 11. While the wrapping 52 is liquid impermeable, it is not completely gas impermeable. Therefore, over time, gases inside the can body will tend to permeate through the wrapping 52 and into the sachet, or visa versa, until the pressure inside the sachet is equal to the pressure inside the sealed can body.

The wrapping 52 may be formed of plastic or other suitable materials. Further, the wrapping 52 may include a perforated section extending to an edge thereof, or a serration along an edge thereof, so as to facilitate easy tearing of the wrapping 52 to gain access to the prize 51 therein. Congratulations, coupons, instructions, or other forms of indicia, may be printed on the wrapping 52. The prize 51 may be in the form of rolled up or folded cash, coupons, or certificates redeemable for cash, goods, or services or any other item to be dispensed.

Figure 5:
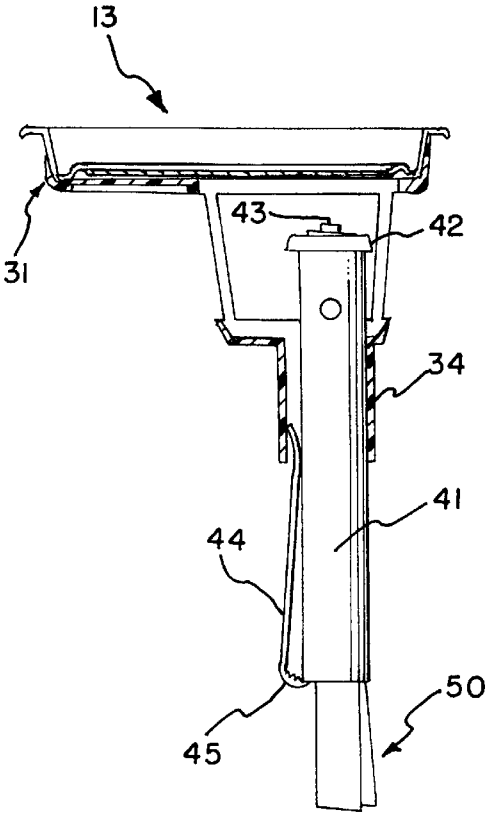
FIG. 5 is a partial cross-sectional view of the prize dispensing assembly when the beverage can is unopened.

Next, the operation of the prize dispensing assembly will be describe with reference to FIGS. 5–9. FIG. 5 illustrates the prize dispensing assembly when the beverage can is unopened, having the openable tab 14 in a closed position. When the prize dispensing assembly is arranged as illustrated in FIG. 5, the holder is firmly fixed inside the cylindrical tube 34 by a frictional engagement.

The frictional engagement is due to the presence of the angled portion 46 of locking strip 44 being sandwiched between the vial 41 and the cylindrical tube 34. The space, or play, between the vial 41 and the cylindrical tube 34 is insufficient to allow the angled portion 46 to assume its forty-five degree angle. Therefore, the angle of the angled portion 46 is reduced. The angled portion 46 has a natural resiliency which tends to reestablish the forty-five degree angle. This natural resiliency causes a tip of the angled portion 46 to bear against the cylindrical tube 34, and thus provide the frictional engagement needed to chock the vial 41 into a fixed relation relative to the cylindrical tube 34.

The cap 42 of the vial 41 is spaced from an underside of the openable tab 14, and therefore cannot be rattled against it. Alternatively, the cap 42 may rest against the underside of the openable tab 14, and the spiral spring 43 of the cap 42 will be utilized to dampen the contact therebetween.

The spiral spring 43 also acts as a safety device in the event the vial 41 becomes dislodged from a locked position in the cylindrical tube 34 while the can body 11 is still closed. The spiral spring 43 acts to dampen any sound which would result from the vial 41 bobbing against the underside of the openable tab 14. The spiral spring 43 would cushion the impact of the bobbing vial 41, and thereby reduce the risk that a consumer could determine that the can body 11 contains a prize.

Figure 6:
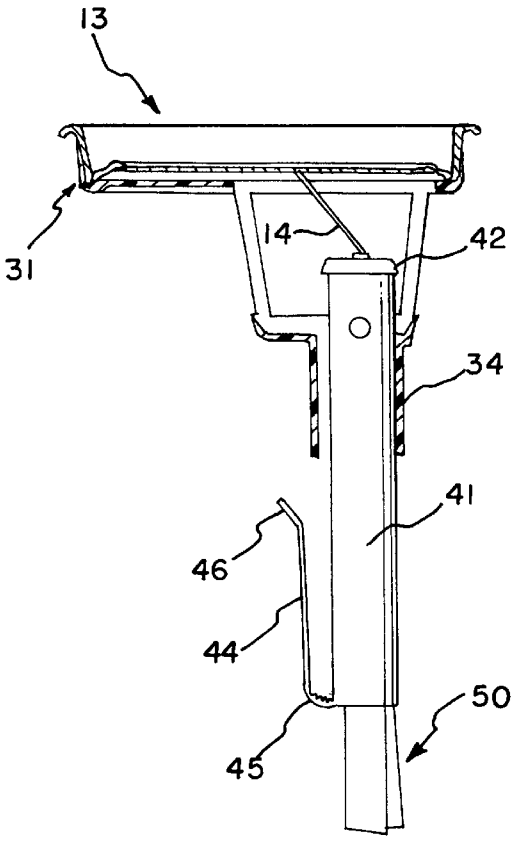
FIG. 6 is partial cross-sectional view of the prize dispensing assembly when the beverage can is initially opened.

FIG. 6 illustrates the opening of the openable tab 14. The openable tab 14 begins a descent into the can body 11, and comes into contact with the cap 42 on the upper end of vial 41. As the openable tab 14 continues into the interior of can body 11, due to a consumer manually pivoting the pivotable tab 16 about the stay 17, the openable tab 14 applies a force to the cap 42. The force overcomes the frictional engagement between the vial 41 and the cylindrical tube 34 caused by the chocking effect of the presence of the angled portion 46 of the locking strip 44 between the vial 41 and the cylindrical tube 34. After a sufficient downward movement of the holder relative to the guide, the locking strip 44 is released from between the vial 41 and the cylindrical tube 34. At this point, the locking strip 44 can move away from the vial 41 as indicated in FIGS. 6 and 7.

Figure 7:
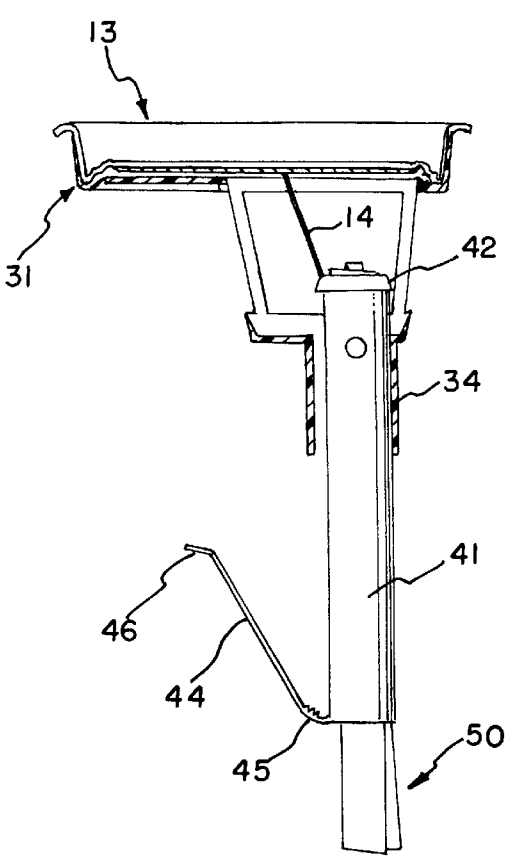
FIG. 7 is partial cross-sectional view of the prize dispensing assembly as the beverage can is further opened.

In FIG. 7, the lowest descent of the vial 41 relative to the lid 13, is shown. This point occurs just prior to the openable tab 14 passing out of contact with the cap 42. After the openable tab 14 passes out of contact with the cap 42, the locking strip 44 having been released from between the cylindrical tube 34 and vial 41, the vial is free to move reciprocally in the cylindrical tube 34.

Figure 8:
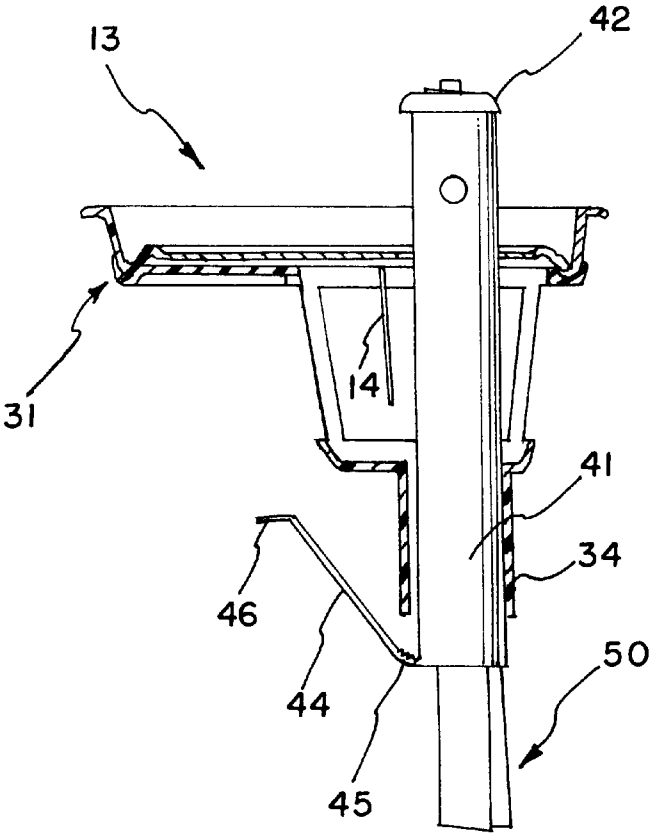
FIG. 8 is a partial cross-sectional view of the prize dispensing assembly delivering the prize holder.

FIG. 8 illustrates the point at which the openable tab 14 has cleared the cap 42. After the openable tab 14 has cleared the cap 42, the vial 41 will tend to rise toward the lid 13, until the cap 42 and an upper portion of the vial 41 protrude above the lid 13. The vial 41 will rise due to buoyancy. The buoyancy is caused in part by a gas pressure inside the wrapping 52 of the sachet 50.

As discussed previously, when the openable tab 14 is in a closed position, a gas pressure in the can body 11 tends to reach an equilibrium with a gas pressure inside the wrapping 52. This equilibrium is reached over a rather extended period of time, since gases may not easily pass through the wrapping 52 due to the relatively low permeability of the wrapping 52. Once the openable tab 14 is opened, gas pressure quickly escapes from the interior of the can body 11. However, gas pressure inside the wrapping 52 of the sachet 50 cannot quickly escape. As a result, the sachet 50 is quite buoyant due to internal gases trapped inside the wrapping 52. Moreover, even without this equalizing of pressure effect, the sachet 50 and vial 41 would tend to naturally float out of the can body 11 due to gases initially trapped in the sachet 50. Therefore, when the vial 41 with the sachet 50 is free of the mechanical restraints of the locking strip 44 and the engagement with the openable tab 14, the vial 41 with the sachet 50 is free to rise out of the can body 11.

Figure 9:
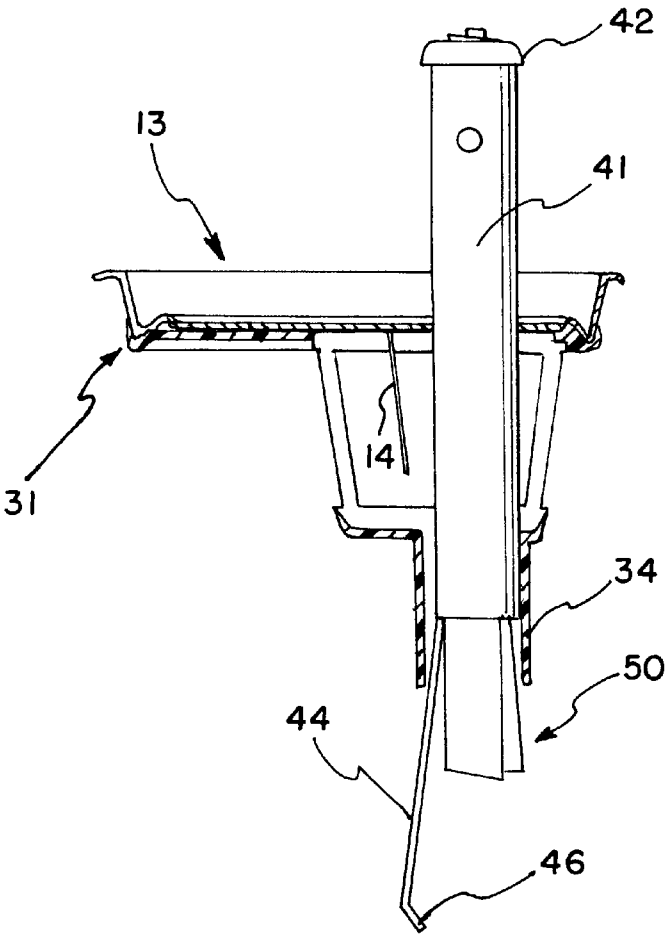
FIG. 9 is a partial cross-sectional view of the prize dispensing assembly as the prize holder is being removed therefrom.

As illustrated in FIG. 9, once the vial 41 protrudes from the lid 13, a person may grasp the upper end of the vial 41 and completely remove the entire holder 40 from the beverage can 10. As the holder passes through the cylindrical tube 34 the locking strip 44 engages a lower edge of the cylindrical tube 34 and assumes a downward orientation. In the downward orientation the locking strip does not chock the vial 41 and the cylindrical tube 34. Therefore, the vial may be easily pulled from the beverage can 10.

By the above disclosed operation of the prize dispensing assembly, with reference to FIGS. 5–9, it should be appreciated that noise in the prize dispensing assembly will be suppressed, so that the prize dispensing assembly cannot be easily detected prior to opening the beverage can.

Figure 18:
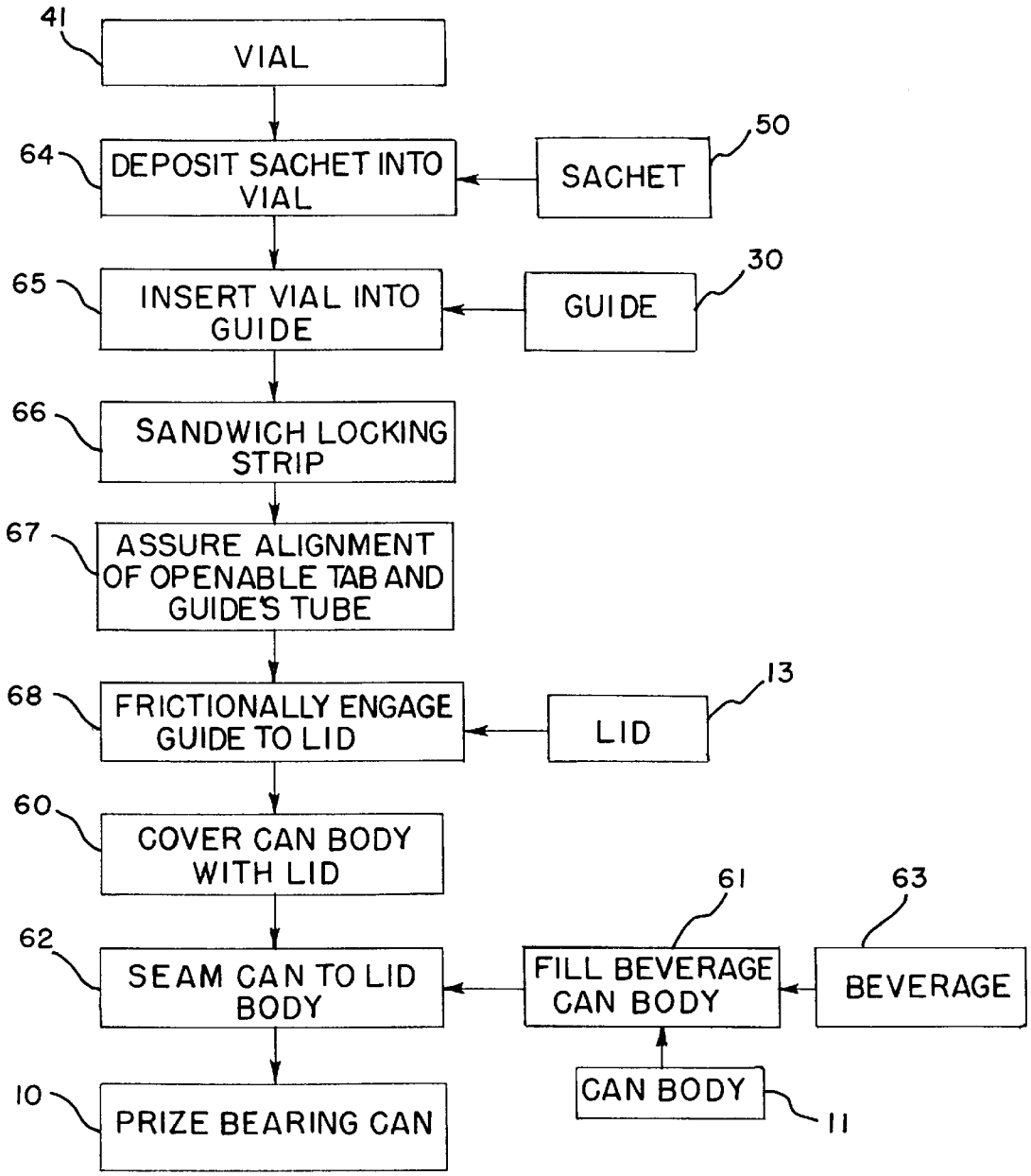
FIG. 18 is a flow chart indicating steps in the assembly of the prize bearing beverage can.

As illustrated in FIG. 18, a method of forming a prize bearing beverage can includes the basic steps of filling 61 the can body 11 with a beverage 63; depositing 64 a sachet 50 into the vial 41; inserting 65 the vial 41 into the cylindrical tube 34; sandwiching 66 the locking strip 44 between the vial 41 and the cylindrical tube 34; aligning 67 the vial 41 with the openable tab 14; frictionally engaging 68 the attachment lip 31 to the lid 13; inserting 60 the prize dispensing assembly 20 into the filled can body 11; and attaching 62 the lid 13 to the open end of the can body 11 by a seaming operation, wherein the attachment lip is sandwiched inside the seam of the lid 13 and the can body 11.

Figure 15:
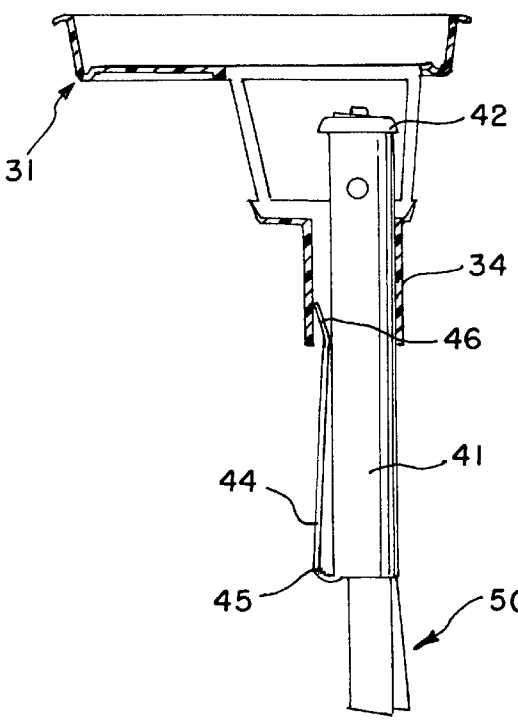
FIG. 15 is a partial cross-sectional view of the prize dispensing assembly with the prize holder fully inserted.
Figure 13:
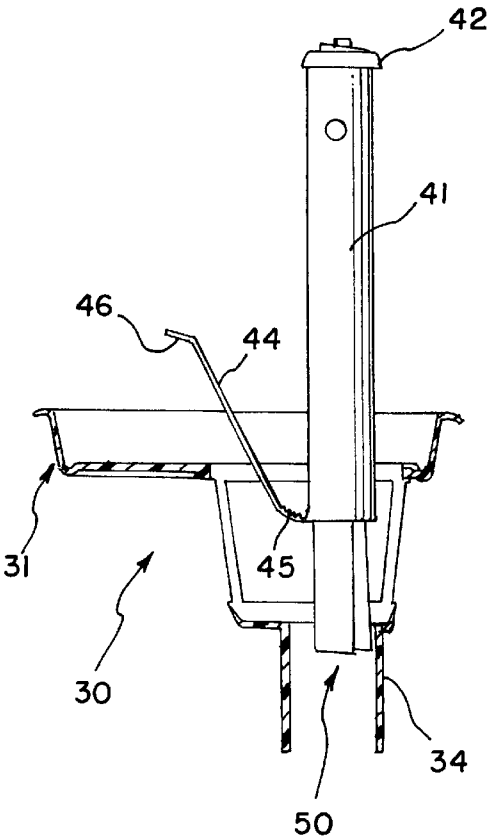
FIG. 13 is a partial cross-sectional view of the prize dispensing assembly when the prize holder is initially inserted.

Now, reference will be made to FIGS. 13–15 in describing a steps of inserting the vial 41 into the cylindrical tube 34, and sandwiching the locking strip 44 between the vial 41 and the cylindrical tube 34. FIG. 13 illustrates inserting an end of the vial 41 having the locking strip 44 attached thereto into the guide 30. The insertion of the vial 41 can be performed automatically by a machine, or manually by a person.

Figure 14:
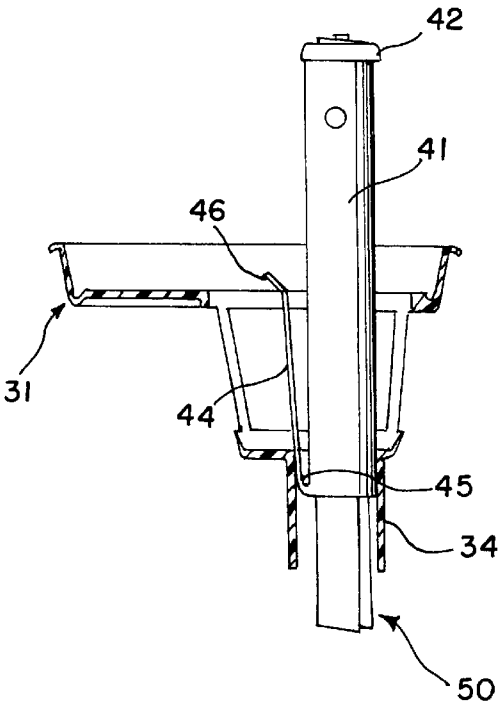
FIG. 14 is a partial cross-sectional view of the prize dispensing assembly as the prize holder is further inserted.

As shown in FIG. 14, the vial 41 is further inserted into the guide 30, until the end of the vial 41, having the locking strip 44 attached thereto, registers with the cylindrical tube 34. As the vial 41 is further pushed into the cylindrical tube 34, the locking strip 44 assumes a position between the vial 41 and the walls of the cylindrical tube 34. As illustrated in FIG. 15, the vial 41 is slid into the cylindrical tube 34, until the angled portion 46 of the locking strip 44 is sandwiched between the vial 41 and the cylindrical tube 34. While the angled portion 46 is shown close to the bottom of cylindrical tube 34, the angled portion 46 of the locking strip 44 could be positioned at any suitable location along the length of the cylindrical tube 34.

Figure 16:
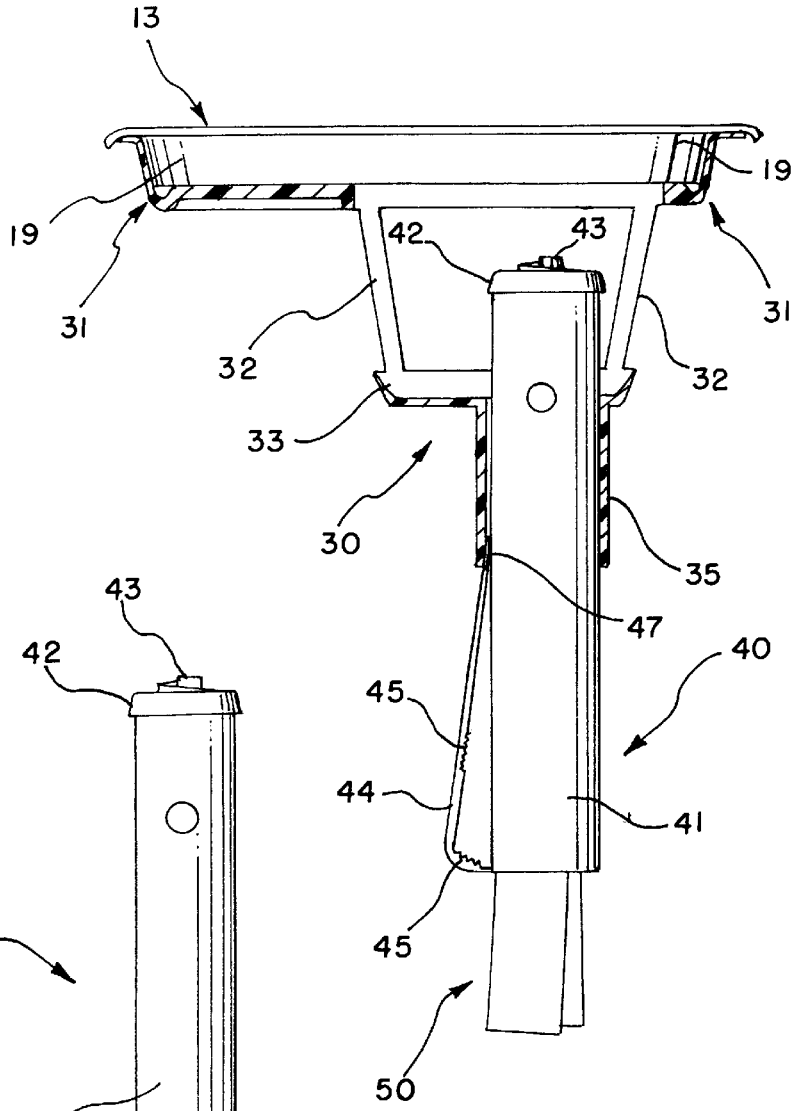
FIG. 16 is a partial cross-sectional view of a prize dispensing assembly according to a further embodiment of the present invention.
Figure 17:
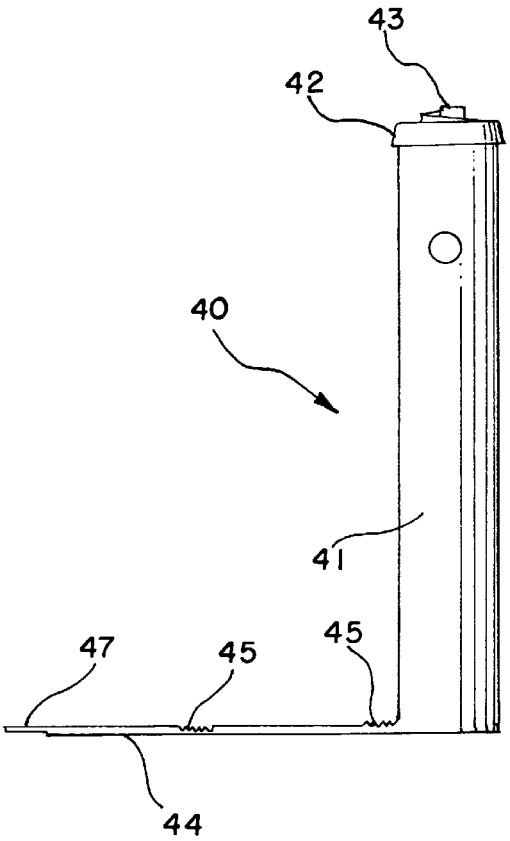
FIG. 17 is a side view of a vial having a locking strip according to the further embodiment of FIG. 16.

FIGS. 16 and 17 illustrate a further embodiment of the present invention. The further embodiment includes a modified locking strip 44 attached to the holder 40. The modified locking strip 44 includes a chocking portion 47 in place of the angled portion 46. The chocking portion 47 has a reduced thickness relative to the remaining portions of the locking strip 44. Also, a cylindrical tube 35 in this further embodiment is slightly reduced in diameter, relative to the cylindrical tube 34 used in conjunction with the preferred embodiment of FIG. 2. Of course, a larger cylindrical tube 35 having a same size as the aforedescribed tube could be used as well be explained below.

The operation and function of the further embodiment is identical to the operation and function of the preferred embodiment, described in conjunction with FIGS. 1–15, except for the following distinctions. The chocking portion 47, having the reduced thickness, is used to chock the vial 41 in the cylindrical tube 35, instead of the angled portion 46. The chocking effect is accomplished by utilizing the resiliencies of the cylindrical tube 35, the chocking portion 47, and the vial 41. Therefore, the dimensional tolerances of the cylindrical tube 35, the chocking portion 47, and the vial 41 must be relatively established and consistent. Consistent dimensional tolerances will ensure that the vial 41 will be sufficiently chocked so as not to come lose from the cylindrical tube 35, yet not so wedged into the cylindrical tube 35 that the openable tab 14 will deform or be unable to push the chocking portion 47 free of the cylindrical tube 35.

The key distinction of the further embodiment is that the cylindrical tube 35 has less space provided between its interior and the vial 41. This can be accomplished by using an oversized cylindrical tube 35 as noted above, by using a vial 41 of increased size, or by any combination of these sizing features. Also, the cylindrical tube 34 and vial 41, having the relative sizes as illustrated in the preferred embodiment, could be used if the chocking portion 47, and/or locking strip 44, has a sufficient thickness to chock the vial 41 within the cylindrical tube 34.

As distinguished from the further embodiment of FIGS. 16 and 17, it can be seen that the chocking effect of the preferred embodiment of FIG. 2 is accomplished primarily by the resiliency of the angled portion 46. The angled portion 46 naturally tends to assume an approximately forty degree angle relative to an adjacent portion of the locking strip 44. When the vial 41 is inserted into the cylindrical tube 34, the clearance between the walls of the cylindrical tube 34 and the vial 41 is insufficient to allow the 3 mm long angled portion 46 to assume its natural forty-five degree angle.

Therefore, the angle of the angled portion 46 is deformed, for example, to an angle of between five to thirty-five degrees. Of course, other ranges of deformation of the angled portion 46 may be equally suitable. The angled portion, through its own resiliency, resists this deformation. This resistance to deformation provides the bulk of the frictional engagement which chocks the vial 41 into the cylindrical tube 34. Since, a wide tolerance in angular deformation is sufficient to adequately chock the vial 41 into the cylindrical tube 34, the dimensional tolerances of the cylindrical tube 34, the locking strip 44, and the vial 41 are not critical to the functioning of the prize dispensing assembly 20.

In the further embodiment of FIGS. 16 and 17, it is contemplated that the vial 41 can be inserted through the top of the cylindrical tube 35. The locking strip 44 is first inserted through the cylindrical tube 35 and then bent to lie alongside the vial 41. The two rippled sections 45 aid in bending the locking strip 44. The chocking portion 47 is inserted between the cylindrical tube 35 and vial 41 to chock the vial 41 in position. Alternatively, the vial 41 can be inserted into the bottom of the cylindrical tube 35 and the chocking portion 47 of the locking strip 44 can be slid between the cylindrical tube 35 and vial 41 during this insertion step.

The prize dispensing assembly 20 of both embodiments may be constructed solely of nonmetallic components. Plastic components are particularly well-suited, due to their light weight and noise dampening characteristics. The use of plastic in forming the components; also assists in achieving the general objective of the present invention, namely suppressing the noise associated with the prize dispensing assembly so that it may not be detected before the beverage can is opened. It is also envisioned that other materials may be used to construct the components of the prize dispensing assembly, and serve equally well in achieving the objectives of the invention.

While the prize dispensing assembly 20 has been described in conjunction with a beverage can 10, it should be understood that the present invention is applicable to other containers, such as containers for dry goods. Further, although a cylindrical beverage can has been illustrated, it should be understood that beverage cans of other shapes and relative proportions may benefit from the prize dispensing assembly according to the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container assembly for housing liquid products and a prize, comprising:

a can body having an open end and a closed end, a lid covering said open end of said can body, said lid having an openable tab, said openable tab closing said can body when in a closed position and providing access to an interior of said can body when in an open position;

a guide located in the interior of said can body and adjacent said openable tab;

a holder movably mounted within said guide; and a locking strip movably mounted on said holder, said locking strip being juxtaposed between said holder and said guide when said openable tab is in the closed position, to chock said holder in a fixed position relative to said guide, said locking strip being released from between said holder and said guide when said openable tab is in the open position, whereby said holder is free to move within said guide.

2. The container assembly as recited in claim 1, wherein said guide comprises:

a generally cylindrical body having two open ends; and a plurality of standoffs, each standoff extending between said lid and said generally cylindrical body.

3. The container assembly as recited in claim 2, wherein said plurality of standoffs is spaced apart so that liquid product inside said can body is flowable between said plurality of standoffs to thereafter be discharged through said lid when said openable tab is in the open position.

4. The container assembly as recited in claim 3, wherein said plurality of standoffs comprises four standoffs.

5. The container assembly as recited in claim 1, further comprising an attachment lip attached to said lid on a side of said lid facing the interior of said can body, and wherein said guide is connected to said attachment lip.

6. The container assembly as recited in claim 2, further comprising an attachment lip located adjacent said lid on a side of said lid facing the interior of said can body, and wherein said guide is connected to said attachment lip, said lid is seamed to said can body to form a seam therebetween, and said attachment lip is fixed relative to said lid by said seam between said lid and said can body.

7. The container assembly as recited in claim 1, wherein said holder is a generally cylindrical vial having at least one open end.

8. The container assembly as recited in claim 7, further comprising a sachet and a prize inside said sachet, said sachet being locatable inside said vial, and said sachet forming a liquid-tight seal around said prize.

9. The container assembly as recited in claim 7, further comprising a cap covering one end of said vial, said cap having a device for dampening contact between said vial and said openable tab.

10. The container assembly as recited in claim 9, wherein said device on said cap is a spiral spring.

11. The container assembly as recited in claim 1, wherein said locking strip comprises an elongated member made of a semi-rigid material, said elongated member having a first end and a second end, and said first end being attached to said holder.

12. The container assembly as recited in claim 11, wherein said elongate member includes a hinge portion adjacent said first end thereof.

13. The container assembly as recited in claim 11, wherein said second end of said elongate member includes an angled portion, said angled portion extending at an angle relative to a portion of said elongated member adjacent said angled portion.

14. The container assembly as recited in claim 13, wherein said angle of said angled portion is approximately forth-five degrees when said locking strip is released from between said holder and said guide.

15. The container assembly as recited in claim 11, wherein said second end includes a chocking portion, said chocking portion extending in a direction which is approximately aligned with a portion of said elongated member adjacent said chocking portion.

16. The container assembly as recited in claim 15, wherein said chocking portion has a thickness which is less than a thickness of said elongated member.

17. The container assembly as recited in claim 1, further comprising a sachet for holding a prize, said sachet being locatable in said holder and being liquid-tight.

18. The container assembly as recited in claim 17, wherein said sachet is gas permeable, such that pressure within said can body and pressure within said sachet can equalize.

19. The container assembly as recited in claim 17, wherein said sachet is rupturable to expose a prize, within said sachet.

20. The container assembly as recited in claim 1, wherein said guide, said holder, and s aid locking strip are constructed of a nonmetallic material.

21. A method of operating and suppressing noise within a prize dispensing assembly of a beverage can, comprising the steps of:

providing a can body and a prize dispensing assembly inside the can body, the prize dispensing assembly including a guide, a holder, and a locking strip connected to the holder;

depositing a prize in the holder;

inserting the holder into the guide; and sandwiching the locking strip between the holder and the guide, wherein the holder with the prize is frictionally held stationary relative to the guide to thereby suppress noise caused by movement of the holder.

22. The method as recited in claim 21, further comprising the steps of:

providing a lid with an openable tab on the can body, and a spring cap on the holder; and resiliently deforming the spring cap upon contact between the spring cap and the openable tab of the lid.

23. The method as recited in claim 21, further comprising the steps of:

providing a lid with an openable tab on the can body;

opening the openable tab;

contacting the openable tab against the holder; and sliding the holder relative to the guide, until the locking strip is released from between the holder and the guide.

24. The method of claim 23, further comprising the steps of:

continuing to open the openable tab until the openable tab has cleared a top of the holder; and floating the holder, due to a buoyancy of the holder, to a position where the top of the holder protrudes through the lid and is located outside the can body.

25. The method of claim 24, further comprising the step of manually pulling the holder out of the can body.

26. A method of forming a prize dispensing beverage can, comprising the steps of:

providing a can body having an open end and a closed end, a lid, and a prize dispensing assembly, the lid having an openable tab, the prize dispensing assembly including a guide, a holder, and a locking strip connected to the holder;

depositing a prize in the holder;

inserting the holder into the guide;

sandwiching the locking strip between the holder and the guide, whereby the holder with the prize is held stationary relative to the guide via a frictional force; and attaching the lid to the open end of the can body.

27. The method of claim 26, further comprising the steps of:

aligning the holder with the openable tab;

frictionally engaging the guide to the lid; and inserting the prize dispensing assembly into the can body, prior to said attaching step.

28. The method of claim 27, wherein said step of attaching the lid comprises seaming the lid to the open end of the can body, and sandwiching a portion of the guide in the seam between the can body and the lid.

29. The method of claim 27, further comprising the step of filling the can body with a beverage, prior to said step of inserting the prize dispensing assembly into the can body.

30. The method of claim 26, wherein said steps of inserting the holder into the guide and sandwiching the locking strip between the holder and the guide, comprise the steps of:

inserting an end of the holder having the locking strip attached thereto into the guide;

pushing the holder and locking strip into the guide, the locking strip having a first end adjacent the holder and a second end distal from the first end;

deforming the second end of the locking strip between the holder and the guide when the second end of the locking strip is pushed into the guide; and exerting pressure on the guide with the deformed second end of the locking strip to thereby lock the holder in position relative to the guide.

31. The method of claim 26, wherein said steps of inserting the holder into the guide and sandwiching the locking strip between the holder and the guide, include the step of chocking an end of the locking strip between the holder and the guide to thereby lock the holder in position relative to the guide.

32. A method of forming a prize dispensing beverage can, comprising the steps of:

providing a can body having an open end and a closed end;

providing a prize dispensing assembly with a prize dispensing portion, the prize dispensing portion including a guide, the guide being connected to an attachment lip of the prize dispensing assembly;

aligning the prize dispensing portion of the prize dispensing assembly with an openable tab of a can lid;

frictionally engaging the attachment lip to the can lid to hold the prize dispensing assembly on the can lid; and inserting the can lid with the prize dispensing assembly onto the open end of the can body to thereby close the can body, wherein the prize dispensing assembly includes a holder and a locking strip connected to the holder, the method further comprising the steps of:

depositing a prize in the holder;

inserting the holder into the guide;

sandwiching the locking strip between the holder and the guide, whereby the holder with the prize is held stationary relative to the guide via a frictional force, the steps of depositing, inserting and sandwiching occurring before the step of frictionally engaging the attachment lip to the can lid; and permanently attaching the can lid to the open end of the can body after the step of inserting the can lid onto the open end of the can body.

33. The method of claim 32, further comprising the step of filling the can body with a beverage, prior to said step of inserting the can lid onto the can body.

34. The method of claim 32, wherein said step of permanently attaching the lid comprises seaming the lid to the open end of the can body, and sandwiching a portion of the attachment lip in the seam between the can body and the lid.

35. The method of claim 32, wherein said steps of inserting the holder into the guide and sandwiching the locking strip between the holder and the guide, comprise inserting an end of the holder having the locking strip attached thereto into the guide; pushing the holder into the guide; causing the locking strip to assume a position between the holder and the guide; and continuing to push the holder until an end of the locking strip is disposed between the holder and the guide.

* * * * *

UNITED STATES PATENT AND TRADEMARK OFFICE

CERTIFICATE OF CORRECTION

PATENT : 6,056,116

DATED : May 2, 2000

INVENTOR(S) : TROSKA

It is certified that error appears in the above-identified patent and that said Letters Patent is hereby corrected as shown below:

CLAIM 14, Col. 9, L. 58, "forth" should read --forty--.

CLAIM 20, Col. 10, L. 12, change "s aid" to --said--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*